US005769099A

United States Patent [19]

Davis et al.

[11] Patent Number: 5,769,099

[45] Date of Patent: Jun. 23, 1998

[54] AUTOMATED NAIL POLISH REMOVER

[75] Inventors: Aaron L. Davis; Mary B. Davis, both of Minnetonka, Minn.

[73] Assignee: Sofspin, San Francisco, Calif.

[21] Appl. No.: 668,408

[22] Filed: Jun. 21, 1996

[51] Int. Cl.[6] ..... A45D 29/05

[52] U.S. Cl. ..... 132/73.6; 132/73; 132/73.5; 132/75.8; 15/97.1; 15/21.1

[58] Field of Search ..... 132/73, 73.5, 73.6, 132/74.5, 75.8, 76.4, 75; 15/97.1, 21.1; 402/219

[56] References Cited

U.S. PATENT DOCUMENTS

| | | | |
|---|---|---|---|
| 2,703,422 | 3/1955 | Roosa . | |
| 3,181,193 | 5/1965 | Nobles et al. . | |
| 3,392,421 | 7/1968 | Mathison . | |
| 4,117,854 | 10/1978 | Rosenbloom | 132/75.8 |
| 4,282,891 | 8/1981 | Duceppe | 132/73.5 |
| 4,319,596 | 3/1982 | Jackson | 132/73.6 |
| 4,510,954 | 4/1985 | Miller | 132/75 |
| 4,800,606 | 1/1989 | Kolesky | 132/73.6 |
| 5,007,441 | 4/1991 | Goldstein | 132/73.6 |
| 5,054,503 | 10/1991 | Keller | 132/73 |
| 5,065,778 | 11/1991 | Terrell | 132/74.5 |
| 5,139,036 | 8/1992 | Pickard | 132/73.5 |
| 5,339,477 | 8/1994 | Warner et al. | 132/73.6 |
| 5,379,474 | 1/1995 | Nakamura | 15/21.1 |

FOREIGN PATENT DOCUMENTS 1 006 829 4/1957 Germany .

*Primary Examiner*—Gene Mancene
*Assistant Examiner*—Pedro Philogene
*Attorney, Agent, or Firm*—Hunton & Williams

[57] ABSTRACT

A device is disclosed for removing fingernail polish simultaneously from a plurality of fingernails of a hand. The device includes a base having a first area adapted for simultaneously receiving a plurality of fingers of the hand. A rotatable sponge is coupled to the base such that the plurality of fingernails of the hand are positionable in contact with the rotatable sponge when the plurality of fingers are positioned in the first area. A motor positioned in the base and coupled to the rotatable sponge controllably rotates the sponge. A palm activated switch on the base actuates the motor when the plurality of fingers of the hand are positioned in the first area of the base to thereby rotate the sponge and remove the fingernail polish from the plurality of fingernails. A hand activated pump controllably supplies fingernail polish removing fluid to the sponge to aid in removal of the fingernail polish.

25 Claims, 5 Drawing Sheets

AUTOMATED NAIL POLISH REMOVER

BACKGROUND OF THE INVENTION

The present invention relates to nail polish removing devices, and more particularly, to a device for use by manicurists or their customers for automatically applying a nail polish removing fluid to the user's fingernails in a controlled manner, while at the same time subjecting the nails to a scrubbing action.

One method in widespread use of removing fingernail polish from fingernails involves a person wetting a piece of cotton with fingernail polish removing fluid and then rubbing the fingernails with the wetted cotton until the fingernail polish has been removed. In addition to being overly time consuming, this commonly used method presents the high probability that fingernail polish removing fluid will be inadvertently dripped or spilled onto clothing, carpets or furniture. Further, this method typically requires that fingernail polish be removed from only one fingernail at a time, further lengthening the process.

A number of automatic fingernail polish removing devices are known in the art. These devices typically have a rotating scrubbing member, such as a brush, which sits partially immersed in a reservoir of fingernail polish removing fluid. One or more of the fingernails of the user's hand are placed in contact with the rotating scrubbing member in order to remove the fingernail polish from the fingernails with the help of a fingernail polish removing fluid. One disadvantage of these prior art fingernail polish removing devices is that a large amount of the fingernail polish remover, in which the scrubbing member is partially immersed, is wasted.

Therefore, there is a need for an improved fingernail polish removing device which can be used to remove fingernail polish from the fingernails of a user's hand in a safe, clean and efficient manner without wasting fingernail polish removing fluid.

SUMMARY OF THE INVENTION

A device is disclosed for removing fingernail polish simultaneously from a plurality of fingernails of a hand. The device includes a base having a first area adapted for simultaneously receiving a plurality of fingers of the hand. A rotatable sponge is coupled to the base such that the plurality of fingernails of the hand are positionable in contact with the rotatable sponge when the plurality of fingers are positioned in the first area. A motor positioned in the base and coupled to the rotatable sponge controllably rotates the sponge. A palm activated switch on the base actuates the motor when the plurality of fingers of the hand are positioned in the first area of the base to thereby rotate the sponge and remove the fingernail polish from the plurality of fingernails. A hand activated pump controllably supplies fingernail polish removing fluid to the sponge to aid in removal of the fingernail polish.

DETAILED DESCRIPTION OF THE PREFERRED EMBODIMENTS

Figure 1:
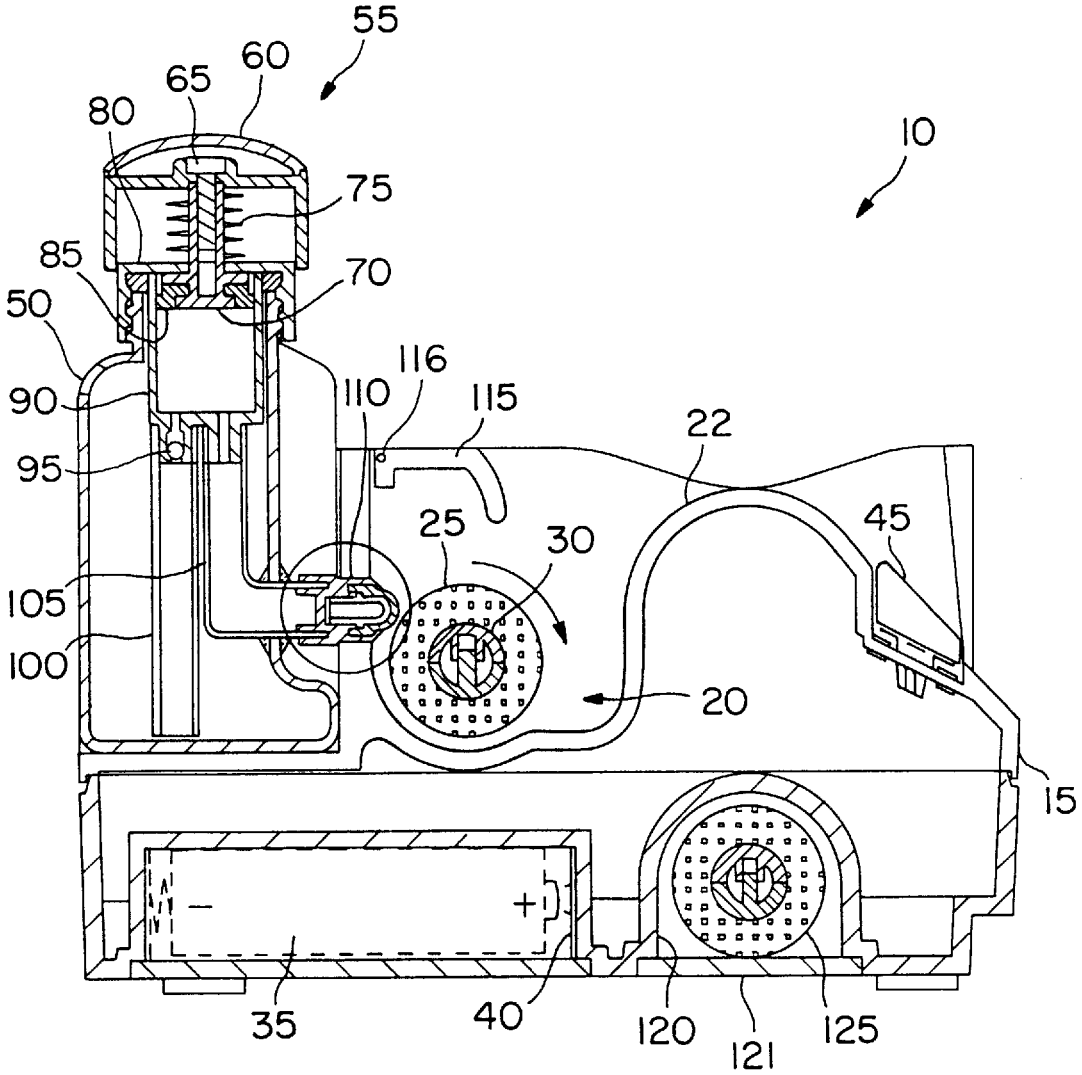
FIG. 1 is a diagrammatic side view, with portions shown in section, of a fingernail polish removing device in accordance with preferred embodiments of the present invention.

FIG. 1 is a diagrammatic side view, with portions shown in section, of fingernail polish removing device 10 in accordance with the preferred embodiments of the present invention. As illustrated in FIG. 1, device 10 includes base or housing 15 which has finger receiving area 20 formed therein. As is illustrated in greater detail in FIG. 5, base 15 also has raised portion 22 formed therein for supporting the area under the knuckles of a user's hand while the fingers of the hand are inserted into area 20. Device 10 also includes generally cylindrical sponge or scrubbing member 25 which rotates on cartridge housing 30. In other embodiments, scrubbing member 25 can be a brush or other similarly suited rotating scrubbing device.

Battery 35 is positioned in battery compartment 40 formed in base 15. Battery 35 provides one of several possible sources of electrical energy needed to power the motor of device 10. As discussed below with reference to FIG. 4, device 10 can alternatively be controlled to operate from a 120 volt or 240 volt AC power source. To control the supply of energy to the motor of device 10, switch 45 is included on base 15, preferably in a position chosen such that it can be actuated by the palm of the user's hand while the fingers of the hand are inserted into area 20.

Device 10 also includes container or reservoir 50 which holds a supply of fingernail polish removing fluid. Container 50 maintains the supply of fingernail polish removing fluid separate from finger receiving area 20 of base 15 and from sponge or member 25. Pump 55 of device 10 is used to controllably and selectively deliver fingernail polish removing fluid to sponge 25 to aid in the removal of fingernail polish from the fingernails of a user's hand, while reducing or minimizing the waste of fingernail polish removing fluid common in some prior art devices.

Pump 55 includes outside cap 60, screw 65, compression cylinder 70, spring 75, inside cap 80, seal 85, compression tube 90, ball valve 95, first tube 100, second tube 105 and shooter 110. Outside cap 60 is connected to compression cylinder 70 by screw 65. Spring 75 is positioned between outside cap 60 and inside cap 80 so that outside cap 60 and compression cylinder 70 are biased in a non-compressed position. Seal 85 helps to provide an airtight configuration in which compression cylinder 70 can be forced downward into compression tube 90 as manual force is applied to outer cap 60, and in which compression cylinder 70 can be forced upward within compression tube 90 as spring 75 moves outside cap 60 and compression cylinder 70 back toward their resting positions. Compression tube 90 is in fluid communication with container 50 through ball valve 95 and first tube 100. Compression tube 90 is in selective fluid communication with sponge 25 using second tube 105 and shooter or spraying device 110. Thus, the fluid path from container 50, through pump 55, to sponge 25 is controllable in a manually actuated manner to prevent the inefficient use or waste of fingernail polish removing fluid. The configuration of device 10 allows the user to manually control the application of fingernail polish removing fluid with one hand, while removing fingernail polish from the other hand. It should be noted that in other embodiments manual pump 55 can be replaced with an electric or otherwise automated pump to achieve the same objective.

Figure 2:
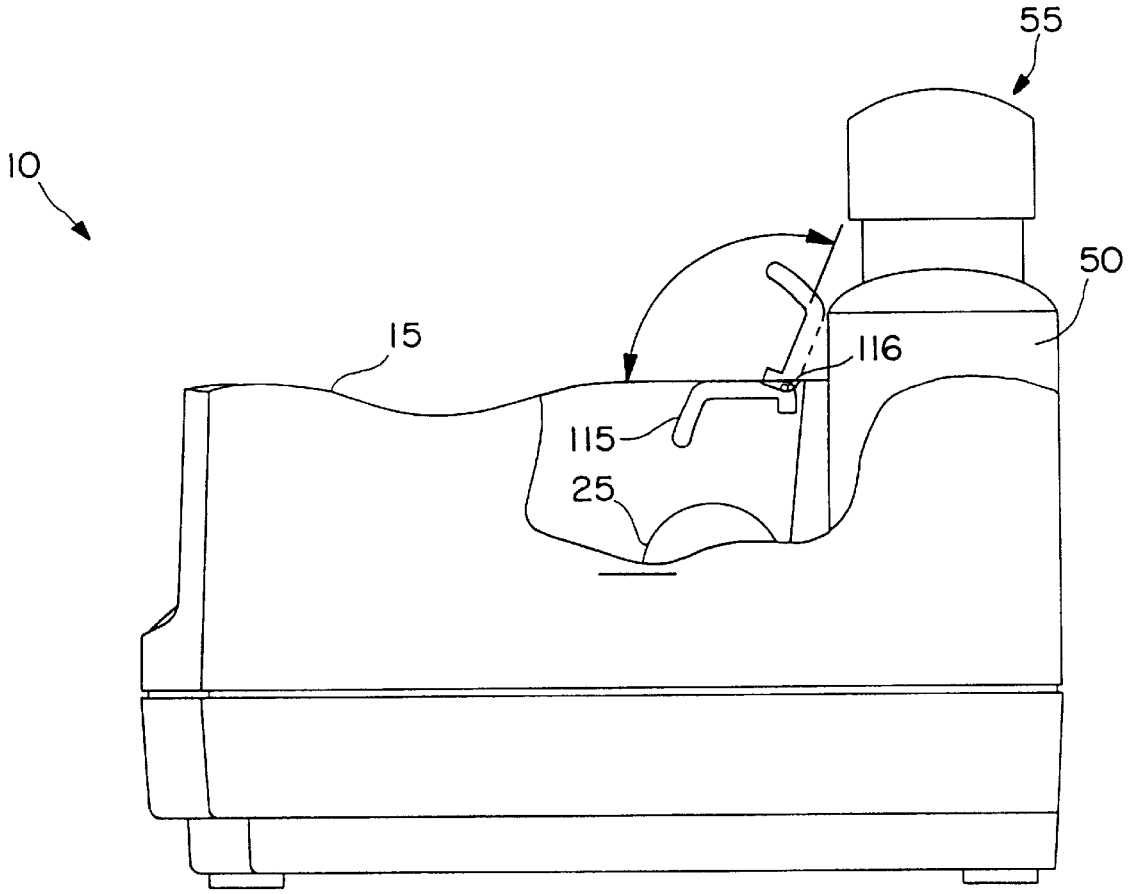
FIG. 2 is a diagrammatic side view of the fingernail polish removing device illustrated in FIG. 1, which further illustrates a movable lid feature of the present invention which allows cleaning or replacement of the rotatable scrubbing member.

Lid 115, which is coupled in a movable fashion to base 15 using pin 116, prevents fingernail polish removing fluid from being sprayed or expelled from finger receiving area 20 by the rotational movement of sponge 25. As illustrated in FIG. 2, lid 115 is rotatably hinged to base 15 by pin 116 such that it can be moved to an open position. As will be discussed later with reference to FIG. 3, with lid 115 in the open position, sponge 25 can be removed from base 15 for cleaning or for replacement. To this end, device 10 includes storage compartment 120 (illustrated in FIG. 1) having lid 121 for storing a replacement sponge 125.

Figure 3:
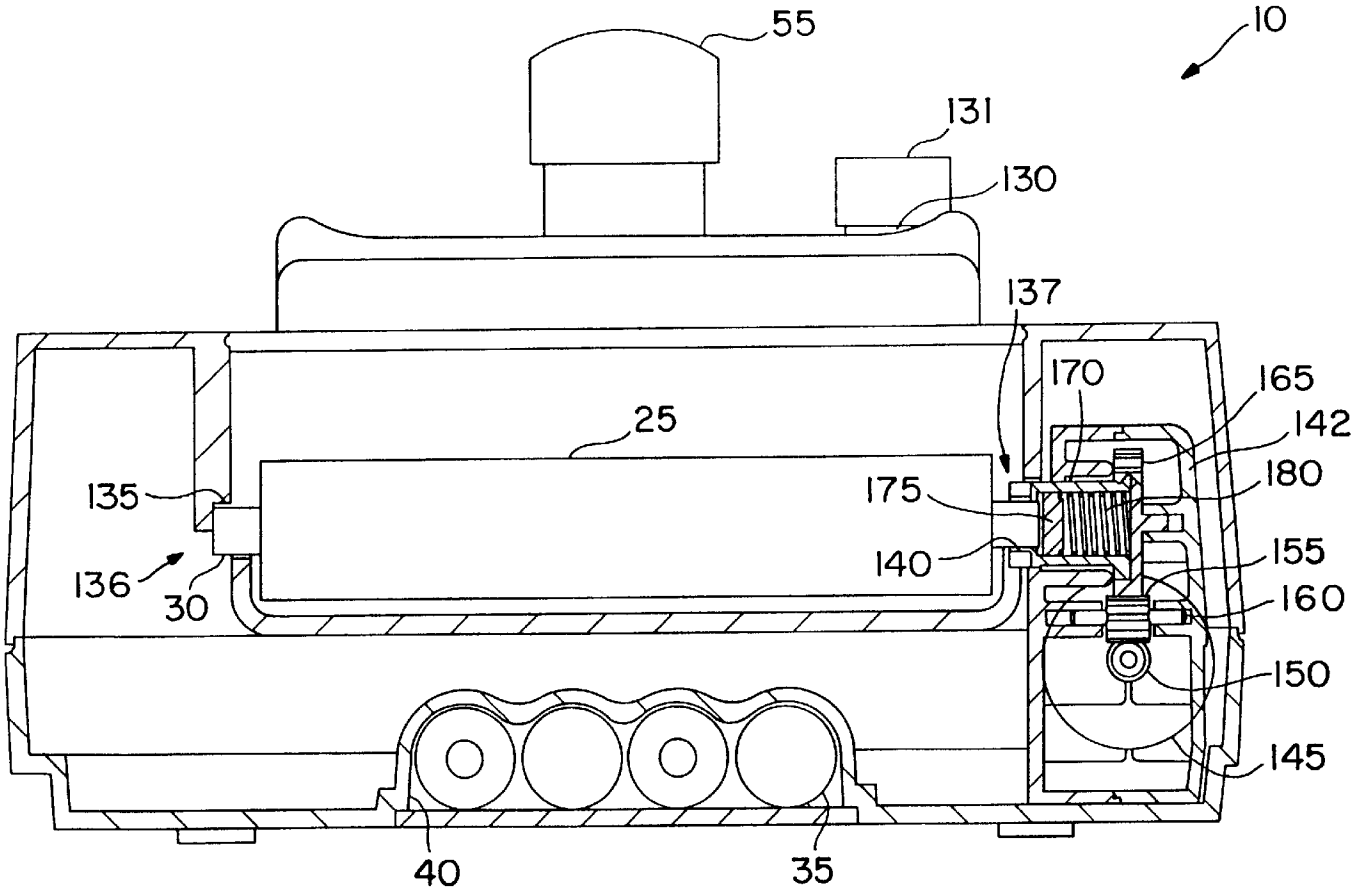
FIG. 3 is a rear view of the fingernail polish removing device illustrated in FIGS. 1 and 2, which further illustrates a gear configuration adapted for allowing the scrubbing member to be removed for cleaning or replacement.

FIG. 3 is a diagrammatic rear view, with portions shown in section, which further illustrates advantageous features of fingernail polish removing device 10 of the present invention. As illustrated in FIG. 3, device 10 includes opening 130 to container 50, and lid 131 for covering opening 130. Thus, container 50 can be easily refilled with fingernail polish removing fluid in a clean, efficient fashion. Also, as illustrated in FIG. 3, device 10 includes cartridge receiving apertures 135 and 140 adapted for receiving first and second ends 136 and 137 of cartridge housing 30.

Device 10 also includes gear box 142, which in turn contains motor 145 and a gear configuration adapted for allowing sponge 25 to be easily removed for cleaning or replacement. Motor 145 is coupled to worm gear 150 for causing rotation of worm gear 150. Worm gear 150 is coupled to pinion gear 155, which rotates on shaft 160 in response to the rotation of worm gear 150. Pinion gear 155 is coupled to output gear 165. Output gear 165 is coupled to output gear adaptor 170 such that output gear 165 and output gear adaptor 170 rotate in unison in response to rotation of pinion gear 155. Compression plate 175 is positioned within output gear adaptor 170. Spring 180 is positioned within output gear adaptor 170, between compression plate 175 and output gear 165. Thus, in normal operation, spring 180 provides a biasing force against compression plate 175 which maintains compression plate 175 in contact with second end 137 of cartridge housing 30. In this manner, when motor 145 is actuated or engaged by compression of switch 45 (illustrated in FIG. 1) during normal operation of device 10, rotational movement of the gears causes rotational movement of compression plate 175, and thus of cartridge housing 30 and sponge 25. However, with lid 115 (illustrated in FIGS. 1 and 2) in an open position, sponge 25 can be removed from finger receiving area 20 by sliding sponge 25 and cartridge housing 30 in a longitudinal direction toward compression plate 175. When spring 180 is sufficiently compressed, first end 136 of cartridge housing 30 clears aperture 135 such that sponge 25 can be removed.

Figure 4:
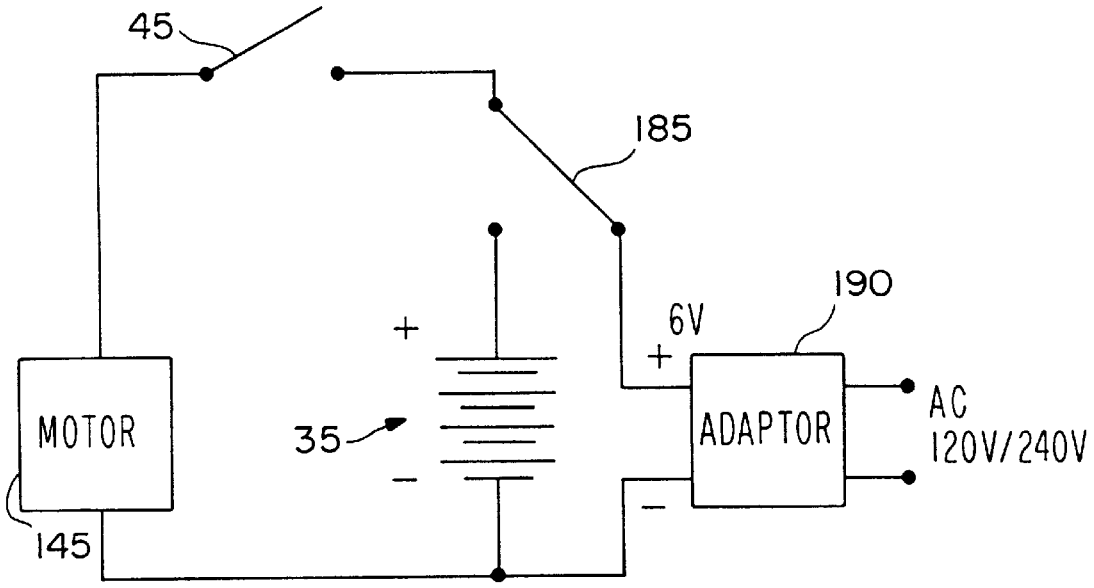
FIG. 4 is a circuit diagram illustrating the various sources of electrical energy which can be used to power the motor of the fingernail polish removing device of the present invention.

FIG. 4 is a circuit diagram illustrating the various sources of electrical energy which can be used to power fingernail polish removing device 10 of the present invention. As can be seen from the electrical circuit illustrated in FIG. 4, switch 185 can be moved between two positions. In the first position as illustrated, switch 185 couples a DC source of power provided by AC to DC adaptor 190 to the rest of the circuit. In this manner, device 10 of the present invention can be powered using either a 120 volt AC power source or a 240 volt AC power source. Adaptors such as adaptor 190 for providing a substantially constant DC power supply (6 volts, as illustrated) from either a 120 volt AC power supply or a 240 volt AC power supply are well-known in the art. In the second position of switch 185, battery 35 provides DC power source for powering device 10. Also as illustrated in FIG. 4, palm actuated switch 45 is biased in a normally open position such that motor 145 receives electrical power only when switch 45 is depressed by the palm of the user's hand.

Figure 5:
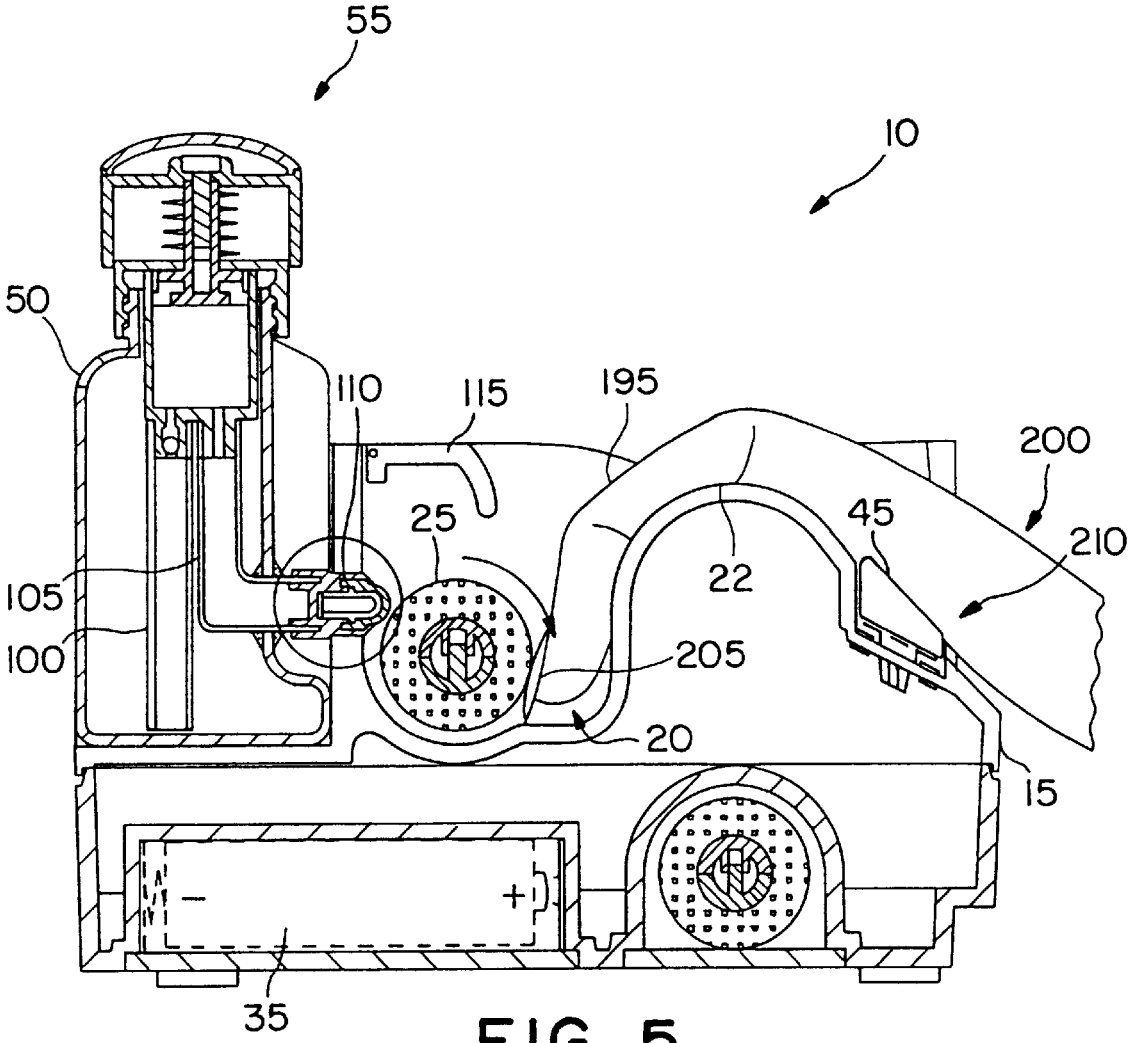
FIG. 5 is a diagrammatic side view with portions shown in section of the fingernail polish removing device illustrated in FIG. 1, which further illustrates the manner in which fingernail polish is removed from the fingernails of a customer's hand.

FIG. 5 is a diagrammatic side view, with portions shown in section, which illustrates operation of device 10 of the present invention in greater detail. As illustrated, fingers 195 of hand 200 of a user have been inserted into finger receiving area 20 of base 15. Raised portion 22 of base 15 supports the user's hand in this position. In this position, fingernails 205 on fingers 195 are positioned adjacent to sponge or scrubbing member 25. Thus, in this position, fingernails 205 are either in contact with sponge 25, or are positioned such that they can be easily placed in contact with sponge 25. Also in this position, palm 210 of hand 200 can be used to depress or actuate switch 45. Thus, motor 145 can be easily controlled to rotate sponge 25 primarily only when hand 200 of the user is in the proper position. This provides increased energy efficiency which will prolong the useful life of batteries 35. Further, with the user able to control motor 145 using only the hand from which the fingernail polish is to be removed, the user's other hand can be employed to manually pump fingernail polish removing fluid from container 50 using pump 55. This provides an additional advantage over conventional fingernail polish removing devices in that the user can control the amount of fingernail polish removing fluid used in order to minimize waste. With a user controlled quantity of fingernail polish removing fluid applied to sponge 25, fingernail polish is efficiently, conveniently and cleanly removed from the fingernails of hand 200.

Although the present invention has been described with reference to preferred embodiments, workers skilled in the art will recognize that changes may be made in form and detail without departing from the spirit and scope of the invention.

What is claimed is:

1. A device for removing fingernail polish simultaneously from a plurality of fingernails of a first hand comprising:

a base having a first area adapted for simultaneously receiving a plurality of fingers of the first hand;

a rotatable sponge coupled to the base such that the plurality of fingernails of the first hand are positionable in contact with the rotatable sponge when the plurality of fingers are positioned in the first area;

a motor positioned in the base and coupled to the rotatable sponge for rotating the rotatable sponge when the motor is actuated; and a switch positioned on the base, the switch being so disposed and arranged on the base such that the switch can be actuated by a palm of the first hand when the plurality of fingers of the first hand are positioned in the first area of the base, wherein the switch is electrically coupled to the motor such that actuation of the switch by the palm of the first hand causes the motor to be actuated to thereby rotate the sponge and remove the fingernail polish from the plurality of fingernails.

2. The device of claim 1 and further comprising:

a reservoir for holding fingernail polish removing fluid, the reservoir holding the fingernail polish removing fluid separate from first area of the base;

a fluid path coupled to the reservoir and adapted for selectively delivering fingernail polish removing fluid to the sponge; and a pump connected to the reservoir for selectively pumping fingernail polish removing fluid from the reservoir and through the fluid path to the sponge.

3. The device of claim 2 wherein the pump is a hand actuated manual pump adapted for actuation by a second hand while the plurality of fingers of the first hand are positioned in the first area of the base.

4. The device of claim 3 and further comprising a lid movably coupled to the base such that the lid at least partially covers the first area while the lid is in a first lid position so that fingernail polish removing fluid is not expelled from the first area during rotation of the sponge, the lid allowing access to the first area while the lid is in a second lid position so that the sponge can be removed from the first area of the base.

5. A device for removing fingernail polish simultaneously from a plurality of fingernails of a first hand comprising:

a housing having a first area adapted for simultaneously receiving a plurality of fingers of the first hand;

a rotatable member coupled to the housing such that the plurality of fingernails of the first hand are positionable in contact with the rotatable member when the plurality of fingers of the first hand are positioned in the first area of the housing, the rotatable member being adapted for removing fingernail polish from the fingernails of the first hand when the rotatable member rotates;

a motor positioned in the housing and coupled to the rotatable member for rotating the rotatable member when the motor is energized; and a switch positioned on the housing in a position such that the switch is actuated by a palm of the first hand when the plurality of fingers of the first hand are received in the first area of the housing, wherein the switch is electrically coupled to the motor such that actuation of the switch by the palm of the first hand causes the motor to be energized to rotate the rotatable member and thereby to remove the fingernail polish from the plurality of fingernails of the first hand.

6. The device of claim 5 wherein the rotatable member includes a generally cylindrical sponge.

7. The device of claim 5 and further comprising:

a reservoir coupled to the housing for holding fingernail polish removing fluid; and a pump connected to the reservoir for controllably pumping fingernail polish removing fluid from the reservoir to the rotatable member.

8. The device of claim 7 wherein the pump is a hand actuated manual pump adapted for actuation by a second hand while the plurality of fingers of the first hand are positioned in the first area of the housing.

9. The device of claim 8 and further comprising a lid rotatably coupled to the housing such that the lid at least partially covers the first area while the lid is in a first lid position so that fingernail polish removing fluid is not expelled from the first area of the housing during rotation of the rotatable member, the lid allowing access to the first area of the housing while the lid is in a second lid position so that the rotatable member can be removed from the first area of the housing for replacement.

10. The device of claim 9 and further comprising a rotatable member storage area in the housing for storing a replacement rotatable member.

11. A device for removing fingernail polish simultaneously from a plurality of fingernails of a first hand using fingernail polish removing fluid comprising:

a base having a finger receiving area adapted for simultaneously receiving a plurality of fingers of the first hand;

a generally cylindrical rotatable member coupled to the base such that the plurality of fingernails of the first hand are positioned adjacent to the rotatable member when the plurality of fingers of the first hand are positioned in the finger receiving area of the base;

a motor coupled to the base and to the rotatable member for rotating the rotatable member when the motor is actuated;

a switch electrically coupled to the motor such that actuation of the switch causes the motor to be actuated to rotate the rotatable member and thereby remove the fingernail polish from the plurality of fingernails;

a reservoir for holding fingernail polish removing fluid, the reservoir holding the fingernail polish removing fluid separate from the finger receiving area of the base; and a fluid pump connected to the reservoir for selectively pumping fingernail polish removing fluid from the reservoir to the rotatable member.

12. The device of claim 11 wherein the pump is a hand actuated manual pump adapted for actuation by a second hand while the plurality of fingers of the first hand are positioned in the finger receiving area of the base.

13. The device of claim 12 wherein the switch is located on the base in a position such that the switch can be actuated by a palm of the first hand when the plurality of fingers of the first hand are positioned in the finger receiving area of the base, wherein actuation of the switch by the palm of the first hand causes the motor to be actuated to rotate the rotatable member and thereby to remove the fingernail polish from the plurality of fingernails.

14. The device of claim 13 wherein the rotatable member includes a generally cylindrical sponge.

15. The device of claim 14 and further comprising a lid movably coupled to the base such that the lid at least partially covers the finger receiving area of the base while the lid is in a first lid position so that fingernail polish removing fluid is not expelled from the finger receiving area during rotation of the sponge, the lid allowing access to the finger receiving area while the lid is in a second lid position so that the sponge can be removed from the finger receiving area of the base for replacement.

16. The device of claim 15 and further comprising a rotatable member storage area in the base for storing a replacement rotatable member.

17. An automated fingernail polish remover comprising: a housing;

a first area of said housing adapted to receive a plurality of fingers of a first hand;

first means operatively positioned with respect said first area and being capable of simultaneously removing fingernail polish from said plurality of fingers; and a switch for operating said first means, said switch being positioned to be actuated by a portion of said first hand while said fingers of said first hand are in said first area.

18. An automated fingernail polish remover comprising:

a housing;

a first area of said housing adapted to receive a plurality of fingers of a first hand;

first means operatively positioned with respect said first area and being capable of simultaneously removing fingernail polish from said plurality of fingers;

a reservoir of fingernail polish removing material, wherein said reservoir is not normally in contact with said first means.

19. The automated fingernail polish remover of claim 18, further comprising means for selectively delivering a portion of said fingernail polish removing material to said first means.

20. The automated fingernail polish remover of claim 18, further comprising a switch for operating said first means, said switch being positioned to be actuated by a portion of said first hand while said fingers of said first hand are in said first area.

21. The automated fingernail polish remover of claim 18, further comprising a lid positioned between said reservoir of fingernail polish removing material and said first means.

22. The automated fingernail polish remover of claim 21, said lid being movable from at least a first position to a second position, wherein in said first position, said lid minimizes undesired spraying of said fingernail polish removing material, and in said second position enables fluid from said reservoir to be supplied to said first means.

23. A device for removing fingernail polish simultaneously from a plurality of fingernails of a first hand comprising:

a base having a first area adapted for simultaneously receiving a plurality of fingers of the first hand;

a rotatable scrubbing member coupled to the base such that the plurality of fingernails of the first hand are positionable in contact with the rotatable scrubbing member when the plurality of fingers are positioned in the first area;

a motor coupled to the rotatable scrubbing member for rotating the rotatable scrubbing member when the motor is actuated; and a switch positioned on the base, the switch being so disposed and arranged on the base such that the switch can be actuated by a portion of the first hand when the plurality of fingers of the first hand are positioned in the first area of the base, wherein the switch is electrically coupled to the motor such that actuation of the switch by the portion of the first hand causes the motor to be actuated to thereby rotate the rotatable scrubbing member and remove the fingernail polish from the plurality of fingernails.

24. A device for removing fingernail polish simultaneously from a plurality of fingernails of a first hand comprising:

a housing having a first area adapted for simultaneously receiving a plurality of fingers of the first hand;

a rotatable member coupled to the housing such that the plurality of fingernails of the first hand are positionable in contact with the rotatable member when the plurality of fingers of the first hand are positioned in the first area of the housing, the rotatable member being adapted for removing fingernail polish from the fingernails of the first hand when the rotatable member rotates;

a motor coupled to the rotatable member for rotating the rotatable member when the motor is energized; and a switch positioned on the housing in a position such that the switch is actuated by the first hand when the plurality of fingers of the first hand are received in the first area of the housing, wherein the switch is electrically coupled to the motor such that actuation of the switch by the first hand causes the motor to be energized to rotate the rotatable member and thereby to remove the fingernail polish from the plurality of fingernails of the first hand.

25. The device of claim 24 wherein the rotatable member includes a generally cylindrical sponge.

* * * * *